US011066719B2

(12) United States Patent
Motoya et al.

(10) Patent No.: US 11,066,719 B2
(45) Date of Patent: Jul. 20, 2021

(54) DUPLEX STAINLESS STEEL AND METHOD OF MANUFACTURING DUPLEX STAINLESS STEEL

(71) Applicant: Nippon Steel & Sumitomo Metal Corporation, Tokyo (JP)

(72) Inventors: Daisuke Motoya, Tokyo (JP); Masayuki Sagara, Tokyo (JP); Hidenori Shitamoto, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 25 days.

(21) Appl. No.: 16/302,816

(22) PCT Filed: May 24, 2017

(86) PCT No.: PCT/JP2017/019439
§ 371 (c)(1),
(2) Date: Nov. 19, 2018

(87) PCT Pub. No.: WO2017/208946
PCT Pub. Date: Dec. 7, 2017

(65) Prior Publication Data

US 2019/0292619 A1 Sep. 26, 2019

(30) Foreign Application Priority Data

Jun. 1, 2016 (JP) ..... JP2016-110101

(51) Int. Cl.
*C21D 9/08* (2006.01)
*C21D 6/00* (2006.01)
(Continued)

(52) U.S. Cl.
CPC ..... *C21D 9/08* (2013.01); *C21D 6/00* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 5,238,508 A * 8/1993 Yoshitake ..... C22C 38/001 148/325
2013/0343948 A1* 12/2013 Oikawa ..... C21D 6/004 420/38

FOREIGN PATENT DOCUMENTS

JP 09316602 A * 12/1997 ..... F16F 1/06
JP 2010084220 A 4/2010
(Continued)

OTHER PUBLICATIONS

English language machine translation of JP-2010222695-A to Oikawa. Generated Jul. 9, 2020. (Year: 2020).*
(Continued)

*Primary Examiner* — Brian D Walck
(74) *Attorney, Agent, or Firm* — Banner & Witcoff, Ltd.

(57) ABSTRACT

A duplex stainless steel with good low-temperature toughness is provided. The duplex stainless steel has a chemical composition of, in mass %: up to 0.03% C; 0.1 to 0.8% Si; up to 2.3% Mn; up to 0.040% P; up to 0.010% S; up to 0.040% sol. Al; 3 to 7% Ni; 20 to 28% Cr; 0.5 to 2.0% Mo; more than 2.0% and not more than 4.0% Cu; 0.02 to 0.5% Co; 0.1 to 0.35% N; up to 0.010% O; and other elements, the steel having a microstructure including an austenite phase and a ferrite phase, the ferrite phase having an area percentage of 30 to 60%, the steel satisfying the following Formula, (1);

$$0.70 \times Ni_L \leq Ni_H \quad (1),$$

where $Ni_H$ and $Ni_L$ are obtained by using an electron-beam microanalyzer to measure Ni content and, in a distribution of Ni content, determining two maximum frequencies, and
(Continued)

treating the one with a higher Ni content as $Ni_H$ and treating the one with a lower Ni content as $Ni_L$.

5 Claims, 2 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/52*** | (2006.01) |
| ***C22C 38/54*** | (2006.01) |
| ***C22C 38/58*** | (2006.01) |
| ***C21D 8/10*** | (2006.01) |

(52) U.S. Cl.
CPC ..... *C21D 6/007* (2013.01); *C21D 6/008* (2013.01); *C21D 8/105* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/52* (2013.01); *C22C 38/54* (2013.01); *C22C 38/58* (2013.01); *C21D 2211/001* (2013.01); *C21D 2211/005* (2013.01)

(56) References Cited

FOREIGN PATENT DOCUMENTS

| | | | | |
|---|---|---|---|---|
| JP | 2010222695 | A | * | 10/2010 |
| JP | 4640536 | B1 | | 3/2011 |
| JP | 5170351 | B1 | | 3/2013 |
| JP | 5206904 | B2 | | 6/2013 |
| JP | 5229425 | B2 | | 7/2013 |
| JP | 2016172891 | A | | 9/2016 |
| WO | WO-2008088282 | A1 | * | 7/2008 |
| WO | 2012111535 | A1 | | 8/2012 |
| WO | 2012121380 | A1 | | 9/2012 |
| WO | WO-2015190422 | A1 | * | 12/2015 |

OTHER PUBLICATIONS

English language machine translation of WO-2015190422-A1 to Takano et al. Generated Nov. 5, 2020. (Year: 2020).*

* cited by examiner

DUPLEX STAINLESS STEEL AND METHOD OF MANUFACTURING DUPLEX STAINLESS STEEL

RELATED APPLICATION DATA

This application is a National Stage Application under 35 U.S.C. 371 of co-pending PCT application number PCT/JP2017/019439 designating the United States and filed May 24, 2017; which claims the benefit of JP application number 2016-110101 and filed Jun. 1, 2016 each of which are hereby incorporated by reference in their entireties.

TECHNICAL FIELD

The present invention relates to a duplex stainless steel and a method of manufacturing a duplex stainless steel. More particularly, the present invention relates to a duplex stainless steel suitable for use as a steel for line pipe, and a method of manufacturing the same.

BACKGROUND ART

Oil and natural gas produced from oil and gas wells contain associated gases that are corrosive gases such as carbon dioxide ($CO_2$) gas and hydrogen sulfide (HO gas. Line pipe for transporting oil and natural gas containing such corrosive gases is made of a high-corrosion-resistance material, such as duplex stainless steel.

Japanese Patent No. 4640536 discloses a duplex stainless steel exhibiting good weldability during high-heat-input welding and good stress-corrosion cracking resistance in chloride environments containing associated gases that are corrosive.

Japanese Patent No. 5170351 discloses a duplex stainless steel having high strength and exhibiting good stress-corrosion cracking resistance and sulfide stress-corrosion cracking resistance in high-temperature chloride environments.

Japanese Patent No. 5206904 discloses a duplex stainless steel with reduced σ-phase precipitation during high-heat-input welding and exhibiting good stress-corrosion cracking resistance in high-temperature chloride environments and having high strength.

Japanese Patent No. 5229425 discloses a duplex stainless steel with high strength and high toughness.

WO 2012/111535 discloses a welded joint of duplex stainless steel with reduced σ-phase precipitation during high-heat-input welding, exhibiting good stress-corrosion cracking resistance in high-temperature chloride environments and having high strength.

WO 2012/121380 discloses an alloy-saving duplex stainless steel having a corrosion resistance substantially equal to that of general-purpose duplex stainless steel and with reduced decrease in the corrosion resistance of heat-affected zones during welding. JP 2010-84220 A discloses a Ni-saving duplex stainless steel with good impact toughness.

DISCLOSURE OF THE INVENTION

Line pipe is expected to find wider application in low-temperature regions, such as the North Sea. A duplex stainless steel used for such applications is required to have not only corrosion resistance, but also low-temperature toughness.

A duplex stainless steel is composed of an austenite phase and a ferrite phase, and its performance depends on the properties of each of these phases. It is known that an increase in the amount of austenite phase increases toughness. However, toughness and the amount of austenite phase are not in a simple proportional relationship, and the optimum ratio is not known. Further, a material having a sufficient toughness for certain temperatures may not have a sufficient toughness for lower temperatures.

Particularly, Japanese Patent Nos. 4640536, 5170351 and 5206904 do not evaluate low-temperature toughness. Japanese Patent No. 5229425 evaluates absorbed energy at 0° C., but does not evaluate the toughness for temperatures lower than 0° C. Japanese Patent No. 5013030 evaluates the low-temperature toughness of weld metal, but does not evaluate the low-temperature toughness of base material.

WO 2012/121380 and JP 2010-84220 teach that their respective duplex stainless steels may be used for applications such as chemical tanks. However, it is unknown whether these duplex stainless steels may be used for line pipe used in acid chloride environments. On the other hand, increasing the contents of alloy elements to increase corrosion resistance may make it difficult to keep the originally intended phase balance.

An object of the present invention is to provide a duplex stainless steel with good low-temperature toughness and a method of manufacturing the same.

A duplex stainless steel according to an embodiment of the present invention has a chemical composition of, in mass %: up to 0.03% C; 0.1 to 0.8% Si; up to 2.3% Mn; up to 0.040% P; up to 0.010% S; up to 0.040% sol. Al; 3 to 7% Ni; 20 to 28% Cr; 0.5 to 2.0% Mo; more than 2.0% and not more than 4.0% Cu; 0.02 to 0.5% Co; 0.1 to 0.35% N; up to 0.010% 0; 0 to 1.5% V; 0 to 0.02% Ca; 0 to 0.02% Mg; 0 to 0.02% B; 0 to 0.2% REM; and the balance being Fe and impurities, the duplex stainless steel having a microstructure including an austenite phase and a ferrite phase, the ferrite phase having an area percentage of 30 to 60%, the duplex stainless steel satisfying the following Formula, (1);

$$0.70 \times Ni_L \leq Ni_H \quad (1),$$

where $Ni_H$ and $Ni_L$ are obtained by using an electron-beam microanalyzer to measure Ni content at points separated by 0.6 μm in an area of 300×300 $\mu m^2$ and, in a distribution of Ni content with a class width of 0.05 mass %, determining two maximum frequencies, and treating the one with a higher Ni content as $Ni_H$ and treating the one with a lower Ni content as $Ni_L$.

A method of manufacturing a duplex stainless steel according to an embodiment of the present invention includes the steps of preparing a material having a chemical composition of, in mass %: up to 0.03% C; 0.1 to 0.8% Si; up to 2.3% Mn; up to 0.040% P; up to 0.010% S; up to 0.040% sol. Al; 3 to 7% Ni; 20 to 28% Cr; 0.5 to 2.0% Mo; more than 2.0% and not more than 4.0% Cu; 0.02 to 0.5% Co; 0.1 to 0.35% N; up to 0.010% 0; 0 to 1.5% V; 0 to 0.02% Ca; 0 to 0.02% Mg; 0 to 0.02% B; 0 to 0.2% REM; and the balance being Fe and impurities; hot-working the material; and subjecting the hot-worked material to solution treatment at a temperature of 960 to 1045° C.

The present invention provides a duplex stainless steel with good low-temperature toughness.

EMBODIMENTS FOR CARRYING OUT THE INVENTION

Figure 1:
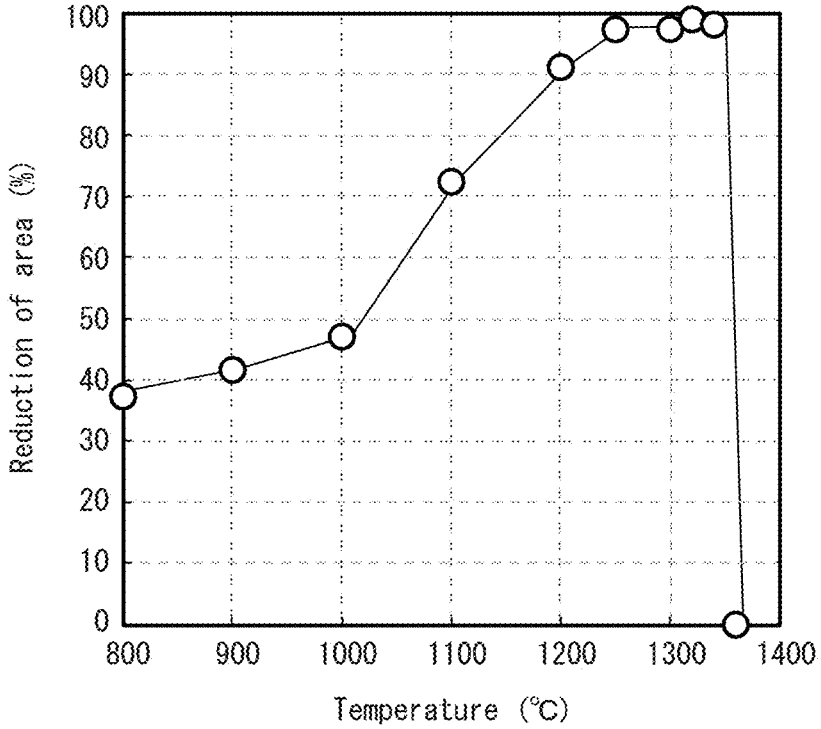
FIG. 1 is a graph showing the results of Greeble tests.

The present inventors investigated the low-temperature toughness of duplex stainless steel and obtained the following findings.

The low-temperature toughness of duplex stainless steel is affected by not only the ratio of austenite phase and ferrite phase, but also the component distribution to these phases. Particularly, it is affected by the Ni distribution in the duplex stainless steel. Specifically, good low-temperature toughness is obtained if the following Formula, (1), is satisfied:

$$0.70 \times Ni_L \leq Ni_H \quad (1),$$

where $Ni_H$ and $Ni_L$ are obtained by, in a distribution of Ni content in the duplex stainless steel, determining two maximum frequencies and treating the one with a higher Ni content as $Ni_H$ and treating the one with a lower Ni content as $Ni_L$.

The ratio of $Ni_H$ to $Ni_L$, i.e. ($Ni_H/Ni_L$), can been adjusted by changing the temperature of solution treatment of the duplex stainless steel during manufacture. Specifically, lowering the temperature of solution treatment increases ($Ni_H/Ni_L$).

On the other hand, if the temperature of solution treatment is lowered, precipitation phase, such as σ-phase and/or precipitates of $Cr_2N$ and/or Cu, may be formed and thus may lower toughness. To prevent precipitation phase from being formed, a normal duplex stainless steel is typically subjected to solution treatment at temperatures near 1070° C.; however, it is difficult to satisfy Formula (1) at these temperatures.

Limiting the contents of elements such as Ni, Mo and Si, particularly Ni content, prevents formation of precipitation phase. On the other hand, Ni serves to improve toughness; as such, if Ni content is limited, the necessary toughness may not be obtained even if Formula (1) is satisfied.

Cobalt (Co) improves the toughness of the duplex stainless steel. Unlike Ni, Co does not promote precipitation of σ-phase. Further, even though Co is an austenite-forming element, its effect is small compared with Ni; thus, including Co does not significantly change the phase balance (i.e. ratio between austenite phase and ferrite phase). In view of this, including Co is effective to make up for the reduction in toughness caused by the limitation of Ni.

To improve toughness, it is also important to reduce non-metallic inclusions. Particularly, it is important to reduce oxide-based inclusions. In view of this, it is necessary to strictly limit the content of oxygen.

If the chemical composition has the values specified above and the temperature of solution treatment is in the range of 960 to 1045° C., Formula (1) is satisfied while preventing formation of precipitation phase. This will provide a duplex stainless steel with good low-temperature toughness.

The present invention was made based on the above-described findings. A duplex stainless steel according to an embodiment of the present invention will now be described.

[Chemical Composition]

The duplex stainless steel according to the present embodiment has the chemical composition described below. In the following description, "%" for the content of an element means mass %.

C: up to 0.03%

Carbon (C) stabilizes austenite. However, if C content is above 0.03%, carbides can easily precipitate, which reduces corrosion resistance. In view of this, C content should be not higher than 0.03%. The lower limit for C content is preferably 0.002%, and more preferably 0.005%. The upper limit for C content is preferably 0.025%, and more preferably 0.02%.

Si: 0.1 to 0.8%

Silicon (Si) improves the fluidity of melt metal during welding, and thus is an effective element for preventing welding defects. This effect is not sufficiently present if Si content is lower than 0.1%. On the other hand, if Si content is above 0.8%, precipitation phase such as σ-phase can easily be formed. In view of this, Si content should be in the range of 0.1 to 0.8%. The lower limit for Si content is preferably 0.2%, and more preferably 0.3%. The upper limit for Si content is preferably 0.7%, and more preferably 0.6%.

Mn: up to 2.3%

Manganese (Mn) improves the hot workability through its desulfurization and deoxidization effects. Further, Mn increases the solubility of N. However, if Mn content exceeds 2.3%, corrosion resistance and toughness decrease. Further, in the context of the duplex stainless steel of the present embodiment, in which the Cu content is relatively high, an excessively high Mn content makes it difficult to keep the appropriate balance between ferrite phase and austenite phase. In view of this, Mn content should be not higher than 2.3%. The lower limit for Mn content is preferably 0.1%, and more preferably 0.5%. The upper limit for Mn content is preferably 2.1%, and more preferably 2.0%. Mn content is still more preferably lower than 2.0%, and yet more preferably not higher than 1.9%.

P: up to 0.040%

Phosphorus (P) exists as an impurity in steel, and reduces the corrosion resistance and toughness of the steel. In view of this, P content should be not higher than 0.040%. P content is preferably not higher than 0.030%, and more preferably not higher than 0.025%.

S: up to 0.010%

Sulfur (S) exists as an impurity in steel, and reduces the hot workability of the steel. Further, sulfides represent initiation points for pitting, and reduce the pitting resistance of the steel. In view of this, S content should be not higher than 0.010%. S content is preferably not higher than 0.005%, and more preferably not higher than 0.002%.

Sol. Al: up to 0.040%

Aluminum (Al) deoxidizes steel. On the other hand, if the N content in the steel is high, Al precipitates in the form of aluminum nitride (AlN), which reduces the toughness and corrosion resistance of the steel. In view of this, Al content should be not higher than 0.040%. The lower limit for Al content is preferably 0.001%, and more preferably 0.005%. The upper limit for Al content is preferably 0.030%, and more preferably 0.025%. Al content as used in the present embodiment means the content of acid-soluble Al (sol. Al).

Ni: 3 to 7%

Nickel (Ni) stabilizes austenite. Ni further improves the toughness of the steel. If Ni content is lower than 3%, these effects are not sufficiently present. On the other hand, if Ni content is above 7%, precipitation phase such as σ-phase can easily be formed. In view of this, Ni content should be in the range of 3 to 7%. The lower limit for Ni content is preferably 3.5%, and more preferably 4.0%. The upper limit for Ni content is preferably 6.5%, and more preferably 6%.

Cr: 20 to 28%

Chromium (Cr) improves the corrosion resistance of steel. This effect is not sufficiently present if Cr content is lower than 20%. On the other hand, if Cr content is above 28%, precipitation phase such as σ-phase can easily be formed. In view of this, Cr content should be in the range of 20 to 28%. The lower limit for Cr content is preferably 21%, and more preferably 22%. The upper limit for Cr content is preferably 27%, and more preferably 26%.

Mo: 0.5 to 2.0%

Molybdenum (Mo) improves the corrosion resistance of steel. This effect is not sufficiently present if Mo content is lower than 0.5%. On the other hand, if Mo content is above 2.0%, precipitation phase such as σ-phase can easily be formed. In view of this, Mo content should be in the range of 0.5 to 2.0%. The lower limit for Mo content is preferably 0.7%, and more preferably 1.0%. The upper limit for Mo content is preferably 1.8%, and more preferably 1.6%.

Cu: more than 2.0% and not more than 4.0%

Copper (Cu), in chloride environments containing corrosive acid gas, strengthens passive film mainly composed of Cr. Further, during high-heat-input welding, Cu precipitates in the form of fine particles in the matrix, which prevents formation of σ-phase on the interface between the ferrite phase and the austenite phase. This effect is not sufficiently present if Cu content is not more than 2.0%. On the other hand, if Cu content exceeds 4.0%, the hot workability of the steel decreases. In view of this, Cu content should be more than 2.0% and not more than 4.0%. The lower limit for Cu content is preferably 2.1%, and more preferably 2.2%. The upper limit for Cu content is preferably 3.8%, and more preferably 3.5%.

Co: 0.02 to 0.5%

Cobalt (Co) improves the toughness of duplex stainless steel. Since the Ni content is limited in the duplex stainless steel according to the present embodiment to prevent formation of precipitation phase such as σ-phase, it is effective to include Co. This effect is not present if Co content is lower than 0.02%. On the other hand, Co is expensive, and adding large amounts of Co may change the phase balance in the steel, potentially affecting its performance. Accordingly, the upper limit for Co content should be 0.5%. In view of this, Co content should be in the range of 0.02 to 0.5%. The lower limit for Co content is more preferably 0.05%, and still more preferably 0.08%. The upper limit for Co content is preferably 0.3%, and more preferably 0.2%.

N: 0.1 to 0.35%

Nitrogen (N) is a powerful austenite-forming element that improves the thermal stability and corrosion resistance of a duplex stainless steel. The duplex stainless steel according to the present embodiment contains large amounts of Cr and Mo, which are ferrite-forming elements; as such, to provide an appropriate balance between ferrite phase and austenite phase, N content should be not lower than 0.1%. On the other hand, if N content is above 0.35%, blowholes are produced during welding. Further, nitrides formed during welding reduce the toughness and corrosion resistance of the weld metal. In view of this, N content should be in the range of 0.1 to 0.35%. The lower limit for N content is preferably 0.12%, and more preferably 0.15%. The upper limit for N content is preferably 0.3%, and more preferably 0.25%.

O: up to 0.010%

Oxygen (O) forms oxides, which are non-metallic inclusions, and reduces the toughness of the duplex stainless steel. In view of this, O content should be not higher than 0.010%. O content is preferably not higher than 0.008%, and more preferably not higher than 0.005%.

The balance of the chemical composition of the duplex stainless steel according to the present embodiment is Fe and impurities. Impurity as used here means an element originating from ore or scrap used as raw material for steel or an element that has entered from the environment or the like during the manufacturing process.

The chemical composition of the duplex stainless steel according to the present embodiment may further include one or more of the elements described below, replacing some of the Fe. All the elements discussed below are optional elements. That is, the chemical composition of the duplex stainless steel according to the present embodiment may include none, one or some of the elements discussed below.

V: 0 to 1.5%

Vanadium (V) is an optional element. V improves the corrosion resistance of the duplex stainless steel. More specifically, if Mo and Cu are also contained, V works together to improve crevice corrosion resistance. This effect is present if a small amount of V is contained. On the other hand, if V content is above 1.5%, an excessive amount of ferrite phase is formed, which reduces toughness and corrosion resistance. In view of this, V content should be in the range of 0 to 1.5%. The lower limit for V content is preferably 0.01%, and more preferably 0.03%. The upper limit for V content is preferably 1.2%, and more preferably 1.0%.

Ca: 0 to 0.02%

Mg: 0 to 0.02%

B: 0 to 0.02%

REM: 0 to 0.2%

All of calcium (Ca), magnesium (Mg), boron (B) and rare-earth elements (REMs) are optional elements. Every one of these elements fixes S and O to improve hot workability. This effect is present if small amounts of these elements are contained. On the other hand, if the content of Ca, Mg or B exceeds 0.02%, non-metallic inclusions increase, reducing toughness and corrosion resistance. In view of this, the content of each of Ca, Mg and B should be in the range of 0 to 0.02%. Similarly, if REM content exceeds 0.2%, non-metallic inclusions increase, reducing toughness and corrosion resistance. In view of this, REM content should be in the range of 0 to 0.2%.

The lower limit for Ca content is preferably 0.0001%, and more preferably 0.0005%. The upper limit for Ca content is preferably 0.01%, and more preferably 0.005%. The lower limit for Mg content is preferably 0.001%, and more preferably 0.005%. The lower limit for B content is preferably 0.0001%, and more preferably 0.0005%. The upper limit for B content is preferably 0.01%, and more preferably 0.005%.

REM is a collective term for the 15 lanthanoids together with Y and Sc (17 elements in total), and one or more of these elements may be contained. REM content means the total content of these elements. The lower limit for REM content is preferably 0.0005%, and more preferably 0.001%. The upper limit for REM content is preferably 0.1%, and more preferably 0.05%.

[Microstructure]

The duplex stainless steel according to the present embodiment is composed of an austenite phase and a ferrite phase, the balance being precipitates and inclusions.

In the microstructure of the duplex stainless steel according to the present embodiment, the area percentage of ferrite phase is 30 to 60%. If the area percentage of ferrite phase is less than 30%, the resulting corrosion resistance is insufficient, being below levels required of a duplex stainless steel. On the other hand, if the area percentage of ferrite phase exceeds 60%, toughness decreases. The lower limit for the area percentage of ferrite phase is preferably 32%, and more preferably 34%. The upper limit for the area percentage of ferrite phase is preferably 55%, and more preferably 50%, and yet more preferably 45%.

The area percentage of ferrite phase may be adjusted by changing the chemical composition and the temperature of solution treatment. Specifically, the area percentage of ferrite phase may be increased by reducing the contents of austenite-forming elements (C, Mn, Ni, Cu, Co, N, etc.) and increasing the contents of ferrite-forming elements (Cr, Mo, etc.). The area percentage of ferrite phase may also be increased by increasing the temperature of solution treatment.

The area percentage of ferrite phase may be measured by the following method: A test specimen is extracted from the duplex stainless steel. The extracted test specimen is mechanically polished and subsequently electropolished. The specimen that has been polished is observed by optical microscopy. The area percentage of ferrite phase is calculated in a field of observation of 350×350 $\mu m^2$. The area percentage of ferrite phase is calculated by the point-counting method according to ASTM E562.

[Explanation of Formula (1)]

The low-temperature toughness of duplex stainless steel is affected by not only the ratio of austenite phase and ferrite phase, but also the component distribution to these phases. Particularly, it is affected by the Ni distribution in the duplex stainless steel. In the duplex stainless steel according to the present embodiment, the following Formula, (1), is satisfied:

$$0.70 \times Ni_L \leq Ni_H \quad (1),$$

where $Ni_H$ and $Ni_L$ are obtained by, in a distribution of Ni content in the duplex stainless steel, determining two maximum frequencies and treating the one with a higher Ni content as $Ni_H$ and treating the one with a lower Ni content as $Ni_L$.

More specifically, $Ni_H$ and $Ni_L$ are calculated by the following method: A test specimen is extracted from the duplex stainless steel. The extracted test specimen is mechanically polished and subsequently electropolished. The test specimen that has been polished is analyzed using an electron-beam microanalyzer. The electron-beam microanalyzer may be JXA-8100 from JEOL Ltd., for example. Specifically, electron beams with an acceleration voltage of 15 kV are used to measure the Ni content for each of points arranged grid-wise and separated by 0.6 μm in an area of 300×300 $\mu m^2$. The resulting data for a total of 250,000 points is used to create a distribution diagram (i.e. histogram) of Ni content, with a class width of 0.05 mass %. In this histogram, two maximum values appear, which correspond to the austenite phase and ferrite phase. Of these two maximum values, the maximum value (or peak value) with a higher Ni content is represented as $Ni_H$, while the maximum value (or peak value) with a lower Ni content is represented as $Ni_L$.

If $(Ni_H/Ni_L)$ is not less than 0.7, good low-temperature toughness will be obtained. $(Ni_H/Ni_L)$ is preferably not less than 0.8, and more preferably not less than 1.0.

[Mechanical Properties]

In the duplex stainless steel according to the present embodiment, the rate of embrittlement defined by the following equation is preferably not higher than 8%:

$$\text{rate of embrittlement (\%)} = \{1-(AE_{-60}/AE_{-20})\} \times 100,$$

where $AE_{-60}$ and $AE_{-20}$ indicate the values of absorbed energy at −60° C. and −20° C. as measured by the testing method in accordance with ASTM A370.

The rate of embrittlement of the duplex stainless steel according to the present embodiment is more preferably not higher than 7%, and more preferably not higher than 6%.

The duplex stainless steel according to the present embodiment preferably has a yield strength not less than 65 ksi (448 MPa), and more preferably a yield strength not less than 70 ksi (483 MPa).

[Manufacturing Method]

An example method of manufacturing the duplex stainless steel according to the present embodiment will be described below. The method of manufacturing the duplex stainless steel according to the present embodiment is not limited to this example.

A material having the above-described chemical composition is prepared. For example, an electric furnace, an Ar—$O_2$ mixed-gas bottom-blown decarburizing furnace (AOD furnace), a vacuum decarburizing furnace (VOD furnace), or the like is used for smelting to produce steel. The molten metal resulting from the smelting may be cast into an ingot, for example, or may be cast into a bar-shaped billet by continuous casting. For example, the molten metal resulting from the smelting is cast into a square slab, which is preferably heated at a temperature of 1250° C. or higher, before being rolled to produce a round-bar billet. Lower heating temperatures before rolling lead to lower working performance.

The prepared material is hot worked into a predetermined shape. The hot working may be, for example, hot rolling or hot forging, piercing/rolling, or hot extrusion. An ingot may be forged into a steel plate, or the round-bar billet that has been produced in the above-discussed manner may be subjected to piercing/rolling to produce a seamless steel pipe.

The heating temperature before hot working is preferably 1250° C. or higher. Lower heating temperatures before hot working lead to lower working performance.

FIG. 1 shows the results of Greeble tests conducted on the steel A, described in Table 1 below. Greeble testing involves performing a tensile test at a high temperature, subsequently determining the reduction of area of the test specimen, and evaluating working performance based on the reduction of area. Larger reductions of area indicate greater deformation and thus better working performance, while lower reductions of area indicate smaller deformation, which may cause a break, indicating inferior working performance. As shown in FIG. 1, in the context of the chemical composition according to the present embodiment, the reduction of area of a test specimen after Greeble testing is constant for the range of 1250 to 1340° C., but the reduction of area decreases at temperatures lower than 1200° C., which means lower working performance.

If working performance decreases, piercing/rolling, which is a step for producing a seamless steel pipe, becomes difficult. The working temperature before hot working is more preferably higher than 1250° C., and still more preferably not lower than 1260° C.

If the heating temperature before hot working is too high, flaws can be generated during hot working. The upper limit for the heating temperature before hot working is preferably 1340° C., and more preferably 1300° C.

The material that has been hot worked is subjected to solution treatment. Specifically, the material is heated to a predetermined temperature of solution treatment and held for a predetermined period of time before being quenched.

The hot material after hot working may be subjected to solution treatment, or the material that has been hot worked may be cooled to near room temperature before being reheated and subjected to solution treatment. Subjecting a hot material to solution treatment after hot working is more preferable since this can prevent formation of precipitation phase during the cooling before solution treatment. However, since the present embodiment uses a material with a chemical composition in which precipitation phase cannot easily be formed, formation of precipitation phase can also be prevented with a manufacture method that involves reheating and solution treatment.

The temperature of solution treatment should be in the range of 960 to 1045° C. If the temperature of solution treatment is lower than 960° C., it is difficult to prevent formation of precipitation phase such as σ-phase and precipitates of Cu. If the temperature of solution treatment is higher than 1045° C., it is difficult to make ($Ni_H/Ni_L$) not less than 0.7. The lower limit for temperature of solution treatment is preferably 965° C., and more preferably 970° C. The upper limit for temperature of solution treatment is preferably 1040° C., and more preferably 1030° C.

The holding time is not limited to any particular amount, but is preferably one represented as a holding time at the temperature of solution treatment of 5 minutes or longer, and more preferably one represented as a holding time at the temperature of solution treatment of 10 minutes or longer. Essentially, saturation is reached at this soaking time, and further prolonging it has little effects. When the viewpoint of manufacture costs is taken into account, the soaking time is preferably not longer than 30 minutes, and more preferably not longer than 20 minutes. The quenching after the holding may be water cooling, for example.

An example method of manufacturing duplex stainless steel has been described. The duplex steel stainless produced by this manufacturing method has good low-temperature toughness.

EXAMPLES

Now, the present invention will be described more specifically with the help of examples. The present invention is not limited to these examples.

Steels having the chemical compositions shown in Table 1 were made by smelting in an electric furnace, and the molten metal was cast into square slabs, which were heated to 1285° C. before being rolled into a round-bar billet. In Table 1, "-" means that the content of the relevant element is at an impurity level.

The produced round-bar billets were heated to 1285° C. before being subjected to piercing/rolling by the Mannesmann method to produce seamless steel pipes. The seamless steel pipes were subjected to solution treatment at different temperatures of solution treatment. For Test Nos. 1 to 19 and 21 in Table 2, provided below, the seamless steel pipes after hot working were cooled to near room temperature, and were then reheated before being subjected to solution treatment. For Test No. 20, the hot seamless steel pipe after hot working was subjected to solution treatment. The holding time at the temperature of solution treatment was 10 minutes for each pipe and, after solution treatment, the pipe was water cooled to room temperature.

A quantitative analysis for Ni content, a microstructure observation, a tensile test and a Charpy test were conducted on each of the seamless steel pipes after solution treatment.

[Quantitative Analysis for Ni Content]

Test specimens were extracted from the seamless steel pipes and $Ni_H$ and $Ni_L$ were determined by the method described in connection with the embodiment. The electron-beam microanalyzer was JXA-8100 from JEOL Ltd., where the acceleration voltage for electron beams was 15 kV. The surface being observed was perpendicular to the pipe-axis direction. An area of 300×300 $\mu m^2$ of each test specimen was observed, and the distribution of Ni content was measured from the data for a total of 250,000 points for each test specimen to determine $Ni_H$ and $Ni_L$.

[Microstructure Observation]

Test specimens were extracted from the seamless steel pipes and the area percentage of ferrite phase for each specimen was determined by the method described in connection with the embodiment. The surface being observed was perpendicular to the pipe-axis direction.

[Tensile Test]

Test specimens were extracted from the seamless steel pipes, and tensile testing was conducted by the test method in accordance with ASTM A370. Each of the test specimens was extracted such that the parallel portion was parallel to the pipe axis. The tests were conducted in room temperature. The 0.2% offset yield strength was treated as the yield strength.

[Charpy Testing]

Test specimens were extracted from the seamless steel pipes and Charpy testing was conducted by the test method in accordance with ASTM A370. Each of the test specimens was extracted to have a width of 5 mm, a thickness of 10 mm, a length of 55 mm and a V-notch depth of 2 mm, where the length direction was parallel to the pipe axis. The tests

TABLE 1

| | Chemical composition (in mass %, balance Fe and impurities) | | | | | | | | | | | | | | | | | |
|---|---|---|---|---|---|---|---|---|---|---|---|---|---|---|---|---|---|---|
| Steel | C | Si | Mn | P | S | Cu | Ni | Cr | Mo | N | sol. Al | Co | O | V | Ca | Mg | B | REM |
| A | 0.016 | 0.47 | 0.96 | 0.021 | 0.0002 | 2.45 | 4.91 | 24.8 | 1.09 | 0.186 | 0.017 | 0.12 | 0.005 | 0.05 | 0.0025 | — | 0.0023 | — |
| B | 0.015 | 0.50 | 1.51 | 0.011 | 0.0008 | 3.41 | 4.21 | 20.4 | 1.98 | 0.189 | 0.020 | 0.11 | 0.003 | — | — | — | — | — |
| C | 0.017 | 0.50 | 1.52 | 0.014 | 0.0011 | 2.20 | 4.08 | 23.9 | 1.56 | 0.198 | 0.021 | 0.11 | 0.001 | 0.06 | 0.0015 | — | — | — |
| D | 0.015 | 0.52 | 1.53 | 0.012 | 0.0005 | 2.56 | 6.82 | 24.2 | 1.92 | 0.305 | 0.013 | 0.11 | 0.002 | — | — | 0.02 | — | — |
| E | 0.016 | 0.52 | 1.03 | 0.016 | 0.0009 | 2.07 | 5.22 | 26.0 | 0.51 | 0.212 | 0.014 | 0.12 | 0.004 | — | — | — | — | 0.0012 |
| F | 0.016 | 0.49 | 1.03 | 0.011 | 0.0008 | 2.15 | 5.23 | 27.1 | 0.52 | 0.202 | 0.015 | 0.11 | 0.008 | 0.08 | — | — | 0.0006 | — |
| G | 0.016 | 0.48 | 1.53 | 0.012 | 0.0009 | 3.22 | 6.21 | ***18.1*** | 1.54 | 0.236 | 0.012 | 0.12 | 0.005 | — | — | — | — | — |
| H | 0.011 | 0.46 | 1.54 | 0.016 | 0.0005 | ***1.05*** | ***7.1*** | 26.7 | ***2.04*** | 0.155 | 0.020 | 0.11 | 0.004 | — | — | — | — | — |
| I | 0.015 | 0.50 | ***2.23*** | 0.015 | 0.0006 | ***1.21*** | 3.08 | 27.8 | ***0.23*** | 0.193 | 0.021 | — | 0.005 | — | — | — | — | — |
| J | 0.015 | 0.50 | 1.52 | 0.014 | 0.0005 | 2.55 | 4.21 | 23.9 | 1.98 | 0.212 | 0.018 | 0.12 | ***0.015*** | 0.07 | 0.001 | — | — | — |
| K | 0.015 | 0.51 | 1.34 | 0.012 | 0.0005 | 2.53 | 4.02 | 23.1 | 1.98 | 0.153 | 0.022 | — | 0.008 | 0.05 | 0.002 | — | — | — |
| L | 0.015 | 0.49 | ***5.08*** | 0.015 | 0.0005 | 2.01 | 4.01 | 25.09 | 1.00 | 0.262 | 0.018 | 0.11 | 0.008 | 0.11 | 0.004 | — | — | — |

were conducted at −20° C. and −60° C. Values of absorbed energy $AE_{-20}$ and $AE_{-60}$ at the respective temperatures were measured to determine the rates of embrittlement. Further, the fracture surface of each test specimen was observed by scanning electron microscopy. For evaluation, a test specimen was determined to have good low-temperature toughness if the shear fracture percentage at −20° C. was 100% and the rate of embrittlement was not higher than 8%.

The conditions for producing the various seamless steel pipes and the evaluation results are shown in Table 2.

TABLE 2

| Test No. | Steel | Temperature of solution treatment (° C.) | $Ni_H/Ni_L$ | Rate of embrittlement (%) | Shear fracture percentage | Ferrite percentage (%) | Yield strength (MPa) | Remarks |
|---|---|---|---|---|---|---|---|---|
| 1 | A | ***700*** | 2.32 | 6.2 | ***X*** | 36.4 | 572 | Comp. steel |
| 2 | A | ***900*** | 1.95 | ***14.3*** | o | 38.1 | 552 | Comp. steel |
| 3 | A | ***950*** | 1.35 | ***14.9*** | o | 37.8 | 562 | Comp. steel |
| 4 | A | 980 | 1.07 | 5.7 | o | 43.9 | 520 | Developed steel |
| 5 | A | 1030 | 0.86 | 6.3 | o | 44.3 | 523 | Developed steel |
| 6 | A | ***1070*** | ***0.65*** | ***8.3*** | o | 44.6 | 532 | Comp. steel |
| 7 | A | ***1100*** | ***0.52*** | ***10.9*** | o | 49.0 | 560 | Comp. steel |
| 8 | B | 1030 | 0.92 | 6.4 | o | 38.9 | 523 | Developed steel |
| 9 | B | ***1100*** | ***0.62*** | ***9.1*** | o | 48.2 | 562 | Comp. steel |
| 10 | C | 1030 | 1.12 | 5.4 | o | 40.5 | 532 | Developed steel |
| 11 | C | ***1070*** | ***0.67*** | ***9.1*** | o | 44.6 | 571 | Comp. steel |
| 12 | D | 1030 | 1.09 | 7.1 | o | 40.6 | 542 | Developed steel |
| 13 | E | 980 | 1.21 | 4.8 | o | 36.7 | 523 | Developed steel |
| 14 | F | 1030 | 1.19 | 6.3 | o | 38.2 | 532 | Developed steel |
| 15 | ***G*** | 1030 | ***0.88*** | ***11.9*** | o | 30.2 | 503 | Comp. steel |
| 16 | ***H*** | 980 | 1.52 | ***16.5*** | o | 38.1 | 521 | Comp. steel |
| 17 | ***I*** | 1030 | 1.01 | ***10.0*** | o | 38.1 | 528 | Comp. steel |
| 18 | ***J*** | 1030 | 1.11 | ***8.6*** | x | 43.2 | 523 | Comp. steel |
| 19 | ***K*** | 980 | 1.06 | ***9.5*** | o | 42.3 | 513 | Comp. steel |
| 20 | A | 1030 | 0.81 | 6.1 | o | 43.7 | 521 | Developed steel |
| 21 | ***L*** | 1030 | — | ***12.9*** | o | ***32.5*** | 634 | Comp. steel |

The column labeled "Temperature of solution treatment" in Table 2 lists holding temperatures during solution treatment. The column labeled "Ferrite percentage" lists the area percentages of ferrite phase for the various seamless steel pipes. "o" in the column labeled "Shear fracture percentage" indicates that, in the Charpy test, the shear fracture percentage of the test specimen at −20° C. was 100%, and "x" in this column indicates that that value was less than 100%. "-" in the column labeled "$Ni_H/Ni_L$" indicates that no quantitative analysis for Ni content was performed.

For each of the seamless steel pipes of Test Nos. 4, 5, 8, 10, 12 to 14 and 20, the shear fracture percentage at −20° C. was 100% and the rate of embrittlement was not higher than 8%.

For the seamless steel pipe of Test No. 1, the shear fracture percentage at −20° C. was smaller than 100%. For each of the seamless steel pipes of Test Nos. 2 and 3, the rate of embrittlement was above 8%. This is presumably because the temperatures of solution treatment for these seamless steel pipes were too low and thus precipitation phase, such as σ-phase, was formed.

For each of the seamless steel pipes of Test Nos. 6, 7, 9 and 11, the rate of embrittlement was above 8%. This is presumably because ($Ni_H/Ni_L$) was too low. ($Ni_H/Ni_L$) was too low presumably because the temperature of solution treatment was too high.

For the seamless steel pipe of Test No. 15, the rate of embrittlement was above 8%. This is presumably because the Cr content of the steel G was too low.

For the seamless steel pipe of Test No. 16, the rate of embrittlement was above 8%. This is presumably because the Ni content of the steel H was too high.

For the seamless steel pipe of Test No. 17, the rate of embrittlement was above 8%. This is presumably because the Co content of the steel I was too low.

For the seamless steel pipe of Test No. 18, the shear fracture percentage at −20° C. was lower than 100%. This is presumably because the O content of the steel J was too high.

For the seamless steel pipe of Test No. 19, the rate of embrittlement was above 8%. This is presumably because the Co content of the steel K was too low.

For the seamless steel pipe of Test No. 21, the rate of embrittlement was above 8%. This is presumably because the Mn content of the steel L was too high and the area percentage of ferrite phase was too low.

Figure 2:
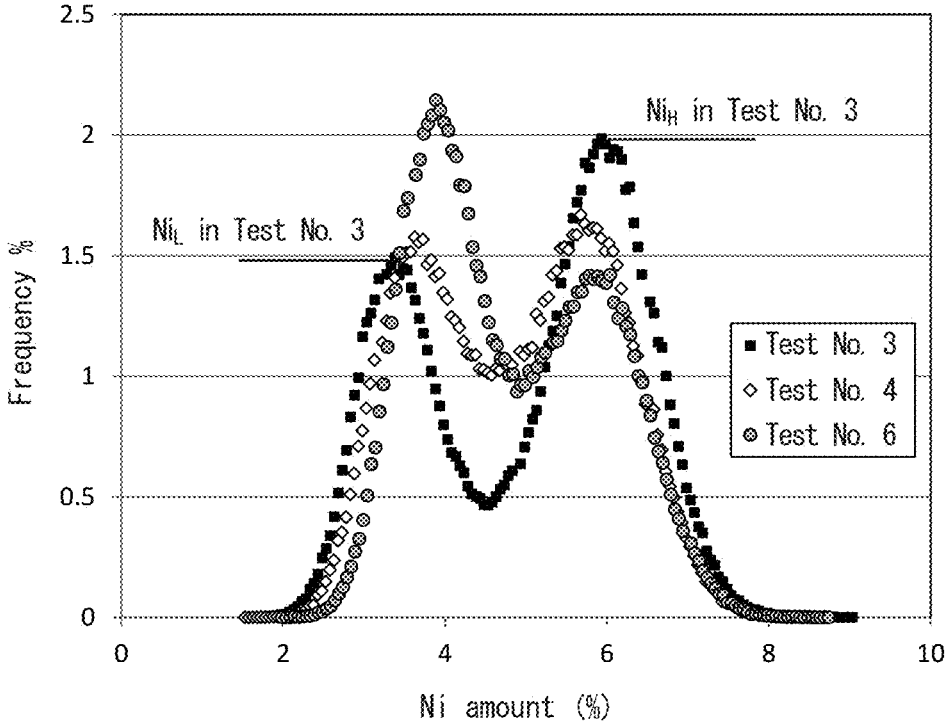
FIG. 2 is a graph showing the distributions of Ni content in steels manufactured in the Examples.
Figure 3:
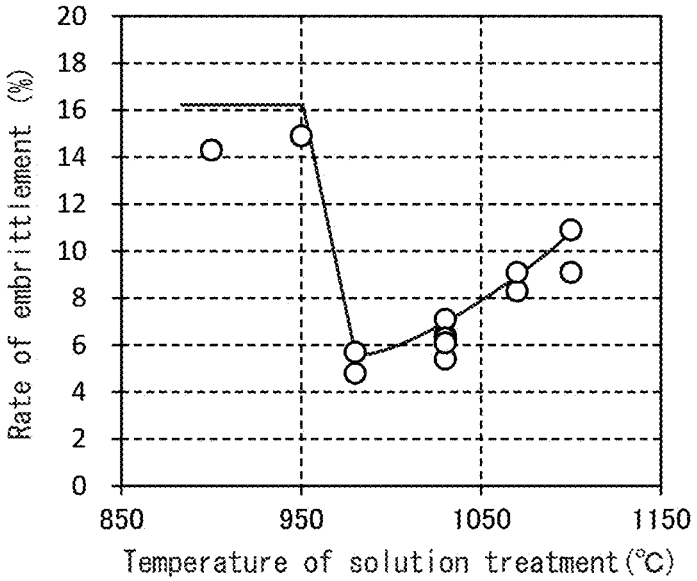
FIG. 3 is a scatter diagram showing the relationship between temperature of solution treatment and rate of embrittlement.
Figure 4:
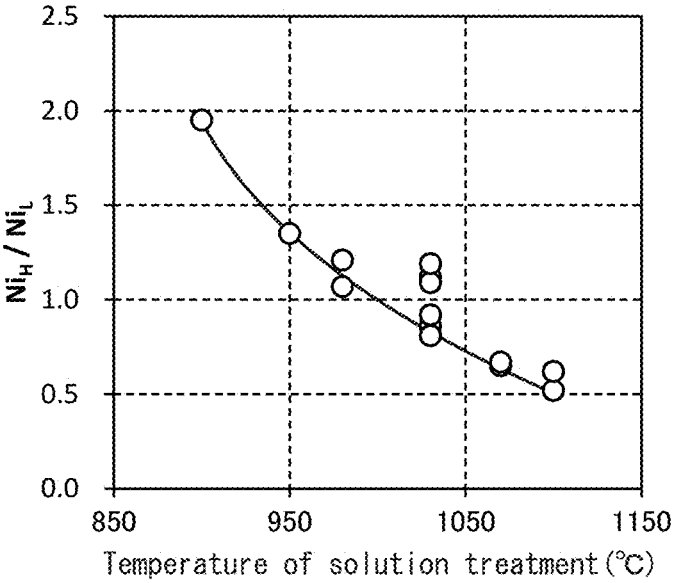
FIG. 4 is a scatter diagram showing the relationship between temperature of solution treatment and ($Ni_H/Ni_L$).

FIG. 2 shows the distributions of Ni content in the seamless steel pipes of Test Nos. 3, 4 and 6. FIG. 3 shows a distribution diagram showing the relationship between temperature of solution treatment and rate of embrittlement, created based on Test Nos. 1 to 14. FIG. 4 shows a distribution diagram showing the relationship between temperature of solution treatment and ($Ni_H/Ni_L$), created based on Test Nos. 1 to 14.

As shown in FIGS. 3 and 4, the lower the temperature of solution treatment, the higher ($Ni_H$/NW becomes and the lower the rate of embrittlement becomes. On the other hand, when the temperature of solution treatment becomes 950° C. or lower, the rate of embrittlement rapidly rises. This is presumably because precipitation phase, such as σ-phase or Cu precipitates, is formed at about 950° C.

An embodiment of the present invention has been described. The above-described embodiment is merely an example for carrying out the present invention. Accordingly, the present invention is not limited to the above-described embodiment, and the above-described embodiment may be modified appropriately without departing from the spirit of the invention.

The invention claimed is:

1. A seamless steel pipe made of a duplex stainless steel having a chemical composition of, in mass %:

up to 0.03% C;

0.1 to 0.8% Si;

up to 1.9% Mn;
up to 0.040% P;
up to 0.010% S;
0.005 to 0.040% sol. Al;
4.21 to 7% Ni;
20 to 28% Cr;
0.5 to 2.0% Mo;
more than 2.0% and not more than 4.0% Cu;
0.02 to 0.5% Co;
0.1 to 0.35% N;
up to 0.010% O;
0 to 1.5% V;
0 to 0.02% Ca;
0 to 0.02% Mg;
0 to 0.02% B;
0 to 0.2% REM; and
the balance being Fe and impurities,
the duplex stainless steel having a microstructure including an austenite phase and a ferrite phase,
the ferrite phase having an area percentage of 30 to 60%,
the duplex stainless steel satisfying the following Formula, (1):

$$0.70 \times Ni_L \leq Ni_H \quad (1),$$

where $Ni_H$ and $Ni_L$ are obtained by the following steps:
(a) measuring Ni content for each of 250,000 points arranged grid-wise on a specimen of the duplex stainless steel and separated by 0.6 μm in an area of 300×300 $\mu m^2$ using an electron-beam microanalyzer;
(b) creating a histogram showing a frequency distribution of the Ni contents measured for the 250,000 points with a class width of 0.05% by mass; and
(c) determining a first maximal value of frequency and a second maximal value of frequency appearing in the histogram, the first maximal value having a higher Ni content and the second maximal value having a lower Ni content, and defining the first maximal value as $Ni_H$ and a second maximal value as $Ni_L$,
wherein the following Formula, (2), is satisfied:

$$\{1-(AE_{-60}/AE_{-20})\} \times 100 \leq 8 \quad (2),$$

where $AE_{-60}$ and $AE_{-20}$ indicate values of absorbed energy of the steel at 60° C. and −20° C., respectively, and
a shear fracture percentage of the steel at −20° C. is 100%.

2. The seamless steel pipe made of the duplex stainless steel according to claim 1, wherein the chemical composition includes, in mass %,
0.01 to 1.5% V.

3. The seamless steel pipe made of the duplex stainless steel according to claim 1, wherein the chemical composition includes one or more selected from the group consisting of, in mass %:
0.0001 to 0.02% Ca;
0.001 to 0.02% Mg;
0.0001 to 0.02% B; and
0.0005 to 0.2% REM.

4. The seamless steel pipe made of the duplex stainless steel according to claim 2, wherein the chemical composition includes one or more selected from the group consisting of, in mass %:
0.0001 to 0.02% Ca;
0.001 to 0.02% Mg;
0.0001 to 0.02% B; and
0.0005 to 0.2% REM.

5. The seamless steel pipe made of the duplex stainless steel according to claim 1 wherein $(Ni_H/Ni_L)$ is not less than 0.8.

* * * * *